US009682399B2

(12) United States Patent
Utterback

(10) Patent No.: US 9,682,399 B2
(45) Date of Patent: Jun. 20, 2017

(54) PAINT ROLLER

(71) Applicant: Affordable Countertop Solutions, Inc., Warrenton, OR (US)

(72) Inventor: Scott Utterback, Warrenton, OR (US)

( * ) Notice: Subject to any disclaimer, the term of this patent is extended or adjusted under 35 U.S.C. 154(b) by 0 days.

(21) Appl. No.: 14/213,884

(22) Filed: Mar. 14, 2014

(65) Prior Publication Data

US 2014/0259497 A1 Sep. 18, 2014

Related U.S. Application Data

(60) Provisional application No. 61/788,464, filed on Mar. 15, 2013.

(51) Int. Cl.
*B05C 17/02* (2006.01)

(52) U.S. Cl.
CPC ..... *B05C 17/0207* (2013.01); *Y10T 29/49817* (2015.01)

(58) Field of Classification Search
CPC ..... B05C 17/02; B05C 17/0207; A46B 3/18
See application file for complete search history.

(56) References Cited

U.S. PATENT DOCUMENTS

| | | | | |
|---|---|---|---|---|
| 2,647,276 | A * | 8/1953 | Thomas | B05C 17/02 15/230.11 |
| 3,866,716 | A * | 2/1975 | Matson | 184/14 |
| 5,264,177 | A * | 11/1993 | Goldstein et al. | 264/318 |
| 5,769,769 | A * | 6/1998 | Torntore | 492/13 |
| 6,231,711 | B1 | 5/2001 | Roberts et al. | |
| 6,419,475 | B1 * | 7/2002 | Wakat et al. | 425/385 |
| 6,685,121 | B1 | 2/2004 | Jelinek et al. | |
| 7,871,362 | B2 | 1/2011 | Kohlruss et al. | |
| 2002/0042331 | A1 * | 4/2002 | Fortner et al. | 492/13 |
| 2009/0191390 | A1 * | 7/2009 | Saji et al. | 428/213 |

* cited by examiner

*Primary Examiner* — Shay Karls
(74) *Attorney, Agent, or Firm* — Chernoff, Vilhauer, McClung & Stenzel, LLP

(57) ABSTRACT

A paint roller sleeve assembly and a method for washing it for reuse. The sleeve assembly includes a core of a size to fit a conventional paint roller handle. The core is compressible by hand radially, to allow a tubular flexible outer cover including a backing layer and a layer of paint-carrying fiber pile to be removed for washing and thereafter be replaced on the core for reuse.

11 Claims, 4 Drawing Sheets

PAINT ROLLER

BACKGROUND OF THE INVENTION

The present invention relates to paint rollers and particularly to a paint roller sleeve assembly that is easily cleaned and therefore can be reused economically.

Paint rollers have been known for decades and are particularly useful for applying water based paints, saving time in application of paint and allowing large surfaces to be painted quickly and easily with a uniform coat.

Typically, paint rollers comprise two major components, a handle assembly and a roller sleeve removably mounted on the handle assembly and that carries and applies paint during use of the paint roller.

The handle assembly typically consists of a grip and an L-shaped metal frame extending from the grip and supporting a rotatable support for a paint roller sleeve.

A paint roller sleeve includes a thin-walled hollow cylindrical core that fits on the rotatable support portion of the handle assembly, and a fabric cover carried on the core and used to carry and apply paint to a surface. The core is typically of either cardboard or plastic material, depending upon the quality of the paint roller. The fabric cover is typically applied as a strip of fabric wound helically onto the outer surface of the core and bonded to it, for example by an adhesive material.

Typically the fabric of the cover is a dense knitted pile fabric that may be knitted from natural fibers such as wool or mohair, synthetic fibers such as polyester, acrylic, nylon, or rayon, or from a blend of natural and synthetic fibers. A knitted fabric backing with a knitted-in pile is ordinarily used. The backing is typically made of synthetic yarns, with the pile being made of a desired natural or synthetic fiber, or a blend of different fibers. The knitted pile fabric is typically coated on the non-pile side with a stabilizing coating composition and the backing is then typically processed by heat treatment to produce a dimensionally stabilized knitted pile fabric.

A paint roller cover manufacturer typically manufactures a paint roller sleeve by wrapping a narrow strip of pile fabric in a helical fashion around a hollow cylindrical core made of cardboard or plastic material, fastening the backing of the pile fabric by an adhesive or by thermally bonding it to the surface of a core.

Such paint roller sleeves are made with a standard interior size of the core, so that the sleeves can be used on a standard handle assembly, from which they can be removed easily for cleaning or replacement. While such a paint roller sleeve including a core can be cleaned, the process is time-consuming and inefficient, even when the roller has been used for water-based paint. Cleaning a sleeve with a cardboard core may result in the deterioration of the core. For people doing their own painting projects the cost of replacing a high quality roller sleeve may be enough of an incentive to clean a paint roller sleeve for reuse, or to refrigerate a used roller sleeve overnight in an airtight package for reuse in the near future. For professional painting, however, it is common to discard a used paint roller sleeve rather than to clean it or otherwise preserve it for reuse at a later time, since the labor cost for cleaning a used roller sleeve, together with the cost of needed water or paint brush cleaner and other solvents, and buckets or other equipment needed to clean a paint roller cover, far outweigh the cost of replacing a used roller sleeve.

As a result, many otherwise perfectly good paint rollers are discarded rather than being cleaned and reused, and the discarded paint roller sleeves become a part of the accumulating waste materials in landfills.

Even when paint roller sleeves are washed carefully, some paint residue is likely to remain and drain to leave a paint ring where a paint roller cover has been left standing on end to dry, or to accumulate at the ends of the fibers of the pile and result in visible differences in the coat of paint applied the next time the roller is used.

What is needed, then, is a paint roller sleeve that can be cleaned for reuse economically enough to justify the cost of producing such a paint roller sleeve with a high-quality pile that can result in an efficient and high-quality application of a coat of paint using such a roller sleeve and thus justify reuse of the sleeve rather than having it prematurely discarded.

SUMMARY OF THE INVENTION

The present invention provides a paint roller sleeve assembly and a method of washing it for reuse that is an answer to some of the shortcomings of previously known paint roller sleeves, as defined by the claims forming a part of the present disclosure.

In one embodiment of the present invention a paint roller sleeve as disclosed herein includes a tubular core that can be fitted onto a conventional paint roller handle and a flexible outer cover including a paint-carrying pile of fiber, that is fitted on the core and kept tight on the core by a tendency of the core to expand radially within the outer cover.

In accordance with the method disclosed herein the outer cover is removed from the tubular core to be washed separately.

In one embodiment the core is a tubular member including a full-length longitudinal slit allowing the core to be compressed radially to a reduced diameter that allows the outer cover to slide onto the core easily, after which the core, when released, expands radially to fit tightly within the outer cover and keep the outer cover securely in place on the core.

In one embodiment the outer cover of the paint roller sleeve includes an outer primary backing layer including a paint-carrying pile, and an inner secondary backing layer of porous sheet material.

In one embodiment the core of the paint roller sleeve disclosed herein includes a surface configuration that engages an inner surface of the outer cover and keeps the outer cover securely in place on the core.

The foregoing and other objectives and features of the invention will be more readily understood upon consideration of the following detailed description of the invention, taken in conjunction with the accompanying drawings.

DETAILED DESCRIPTION OF EMBODIMENTS

Figure 1:
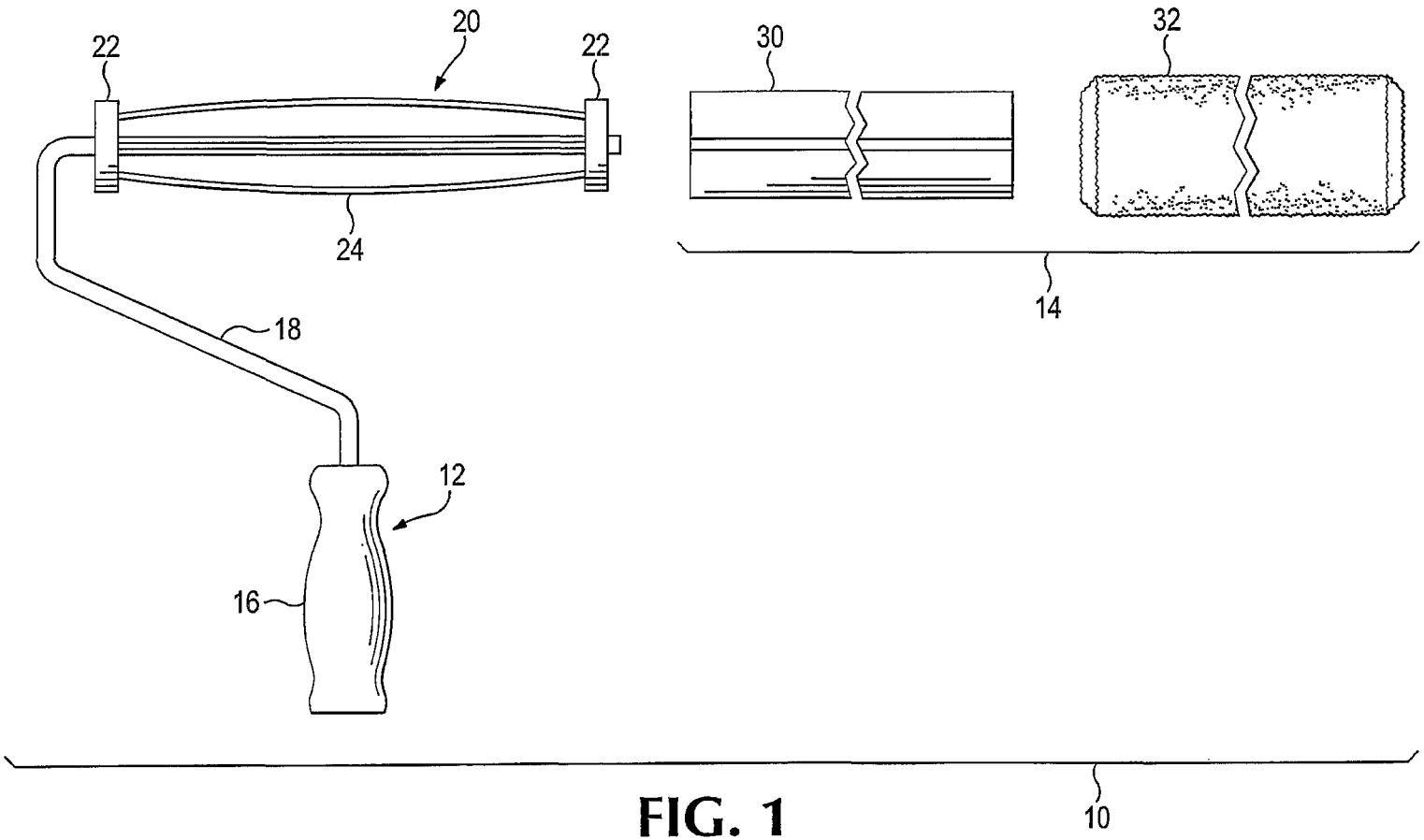
FIG. 1 is an exploded perspective view of a paint roller including a sleeve assembly that is one embodiment of the present invention.

Referring now to the drawings which form a part of the disclosure herein, FIG. 1 shows a paint roller 10 including a handle assembly 12 and a sleeve assembly 14. The handle assembly 12 includes a hand grip 16, a frame 18, and a rotatable sleeve support 20. The sleeve support 20 may have a pair of circular end caps 22 arranged to rotate on an axle portion of the frame 18 and interconnected with each other by a structure such as several rods 24 that may be curved outwardly to firmly engage the interior of the core of a sleeve assembly 14. The sleeve assembly 14, unlike previously known paint roller sleeve assembly, includes two distinct and separable elements, a core 30, shown foreshortened in FIG. 1, and a flexible outer cover 32, also shown foreshortened, that fits tightly over the core 30 when the paint roller 10 is in use.

Figure 2:
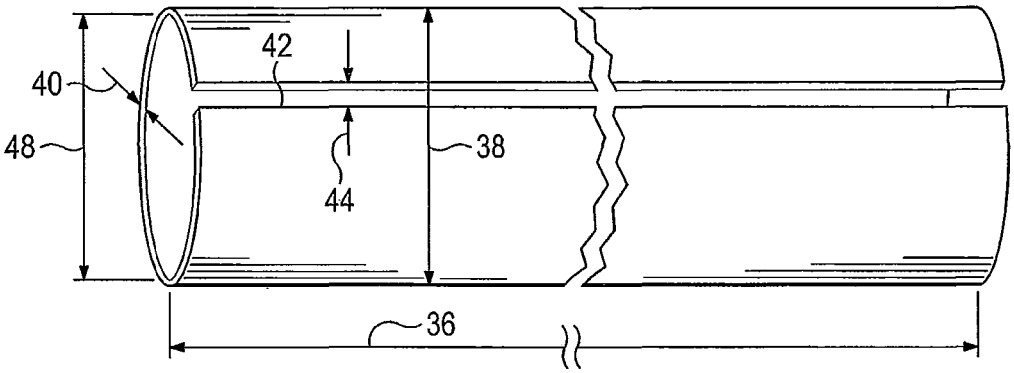
FIG. 2 is a perspective view of the core portion of the paint roller sleeve assembly shown in FIG. 1, at an enlarged scale.

As shown in FIG. 2, the sleeve assembly core 30, in the embodiment disclosed herein, is a cylinder having a length 36 that may be of any standard paint roller length, for example, 9 inches, and a diameter 38 corresponding to the standard size for end caps 22 and frame rods 24, so that the core 30 will fit securely on the sleeve support 20 when the sleeve assembly 14 is assembled. The core 30 may be of an elastic material such as PVC or another suitable plastic resin, with a wall thickness 40 giving the core 30 appropriate strength as will be understood presently. The core 30 could also be made of a suitable metal, such as sheet steel, if the metal has an appropriate coating or is inert in the presence of the type of paint for which the paint roller 10 is intended. The core 30 is generally cylindrical, as may be seen in FIG. 2, but it includes a slit 42 extending over the entire length of the core 30 and having a slit width 44 of, for example about $3/16^{th}$ of an inch. While the slit 42 is shown as being completely straight in FIG. 2 it will be understood that the slit 42 need not be straight, so long as it does offer the possibility of compressing the core 30 to a smaller diameter than the diameter 38 of the core when it is relaxed and separate from the outer cover 32. The wall thickness 40 should be, depending upon the material of which the core 30 is made, appropriate to permit the core 30 to be squeezed by a person using one hand to reduce or completely eliminate the slit width 44 when the core is compressed.

It is critical, however, that the interior diameter 48 of the core 30 be chosen to fit the sleeve support 20 portion of the handle assembly 12 when the sleeve assembly 14 is assembled with an outer cover 32 on the core 30.

Figure 3:
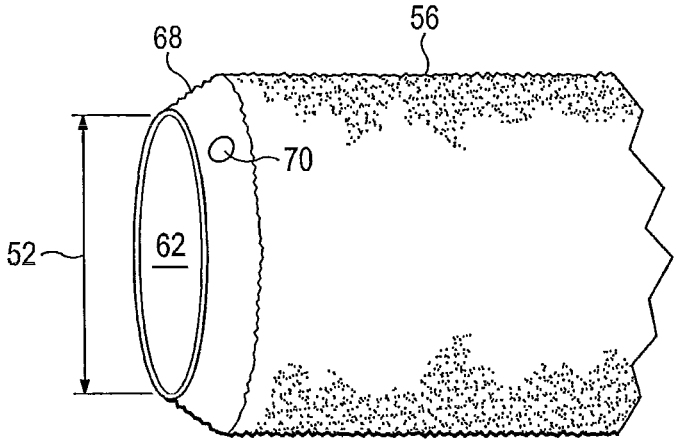
FIG. 3 is a perspective view of a portion of the outer cover part of the paint roller sleeve assembly shown in FIG. 1, at an enlarged scale.
Figure 4:
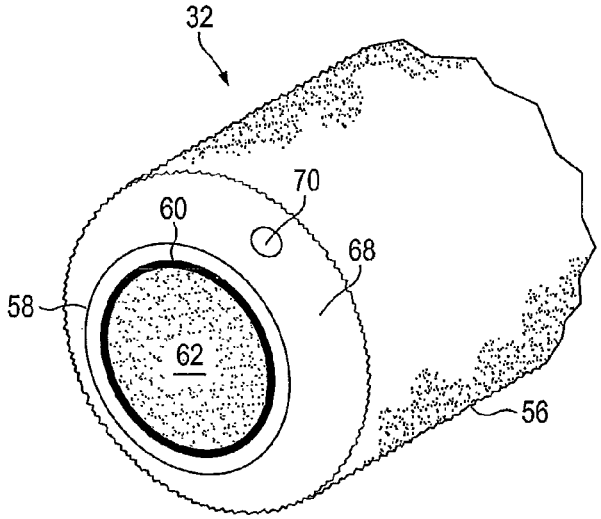
FIG. 4 is another view of a portion of the outer cover part of the paint roller sleeve assembly shown in FIG. 3, from an end perspective.
Figure 5:
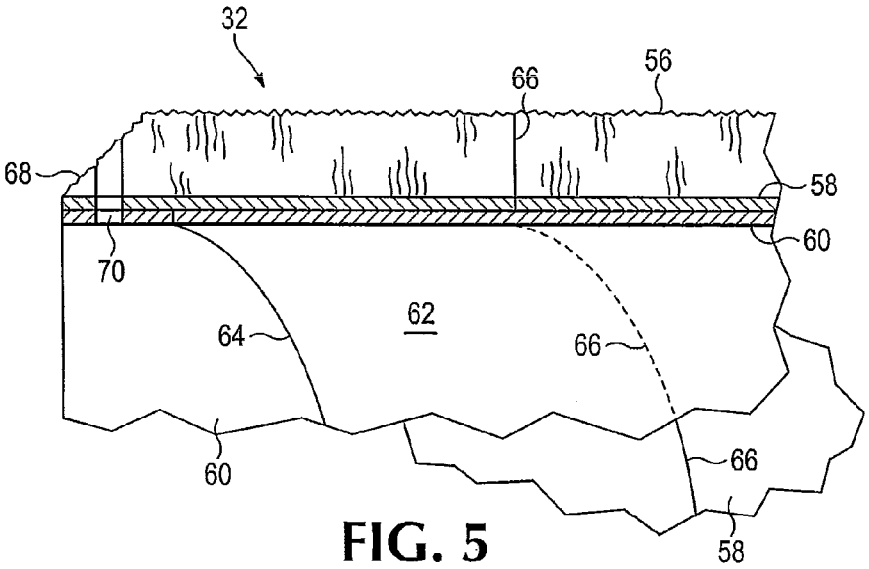
FIG. 5 is a cutaway sectional side elevational view of a portion of the outer cover portion of the paint roller sleeve assembly shown in FIG. 1, at an enlarged scale.

As shown in FIGS. 3, 4, and 5, the outer cover 32 is generally cylindrical and has an inside diameter 52 that is slightly smaller than the diameter 38 of the core 30 when the core 30 is separated from the outer cover 32 and able to expand elastically to its normal relaxed state as shown in FIG. 2. The inside diameter 52 of the outer cover 32 is, however, great enough so that when the core 30 is squeezed, closing or reducing the width 44 of the slit 42, the outer cover 32 can be slid readily into place surrounding the core 30 and aligned longitudinally along the core 30.

The outer cover 32 has a nap or pile 56 of wool, polyester fibers, or other material commonly used for the pile of a conventional paint roller sleeve, and may be manufactured in any of several different pile depths, ranging, for example, from 5 millimeters through 30 millimeters in radial thickness, and can be manufactured with different densities or textures and trimmed to desired surface shapes as with conventional paint roller sleeves. The pile 56 may be manufactured of conventionally used materials including a primary backing fabric such as a conventional knitted backing material that may be treated with a stabilizing coating composition so that it is dimensionally stable, to retain its shape and size in use and when subjected to the elastic force of the core 32 attempting to resume its expanded, relaxed, size.

Arranged within the primary backing layer 58 is an inner or secondary backing layer 60 of a strong, dimensionally stable fabric, also formed into a cylindrical configuration and bonded to the outer, primary backing layer 58, either by adhesives or by thermal bonding, depending upon the materials of the two backing layers 58 and 60. Both the primary backing layer 58 carrying the outer pile layer 56 and the inner, secondary backing material must be amply porous to permit passage of water or other paint solvents through the outer cover 32 from within the interior of the outer cover 32, so as to flush paint effectively from the fibers of the pile 56.

It is also desirable that the material of the inner, secondary backing layer 60 have a rubber-like slip-resistant surface texture as the interior surface 62 of the outer cover 32. The secondary or inner backing layer 60 may be of a thin, strong rubber or synthetic rubber or silicone material or of a durable, pliable textile fabric treated with a rubber-like material to provide the desired texture for the interior surface 62. For a material which is not inherently porous a pattern of small holes may be provided in the inner backing material of the layer 60. Such holes may be of different sizes, for example $1/8^{th}$ inch to ¼ inch in diameter as circular holes, and may be of various shapes, depending upon the material and its ability to withstand the stresses of washing the outer cover 32.

As may be seen in FIG. 5, the backing layers 58 and 60 may be wound in offset helices to form the cylindrical shape of the outer cover 32. In FIG. 5, a helical joint 64 is visible in the inner backing layer 60, and a helical joint 66 between adjacent turns of the outer backing layer 58 that carries the pile fibers 56 is hidden behind the material of the inner backing layer 60. As with a cardboard core of a conventional paint roller sleeve, the inner or secondary backing layer 60 may be wrapped as a 3-inch-wide strip in a helix around a suitable mandrel, and the outer backing layer 58 carrying the pile layer 56 may also be wrapped as a 3-inch-wide strip, in a helical wrapping offset by about 1 and ½ inches longitudinally of the outer cover 32, so that the inner backing layer 60 supports and holds together the primary backing layer 58 and its associated layer of pile 56. End portions 68 of the outer cover 32 may be tapered to a conical surface at each end. A hole 70 is desirably made through the backing layers 58 and 60 and the nap or pile 56 in at least one end portion 68 to receive a hook from which the outer cover 32 may be hung to dry after its has been washed.

Figure 6:
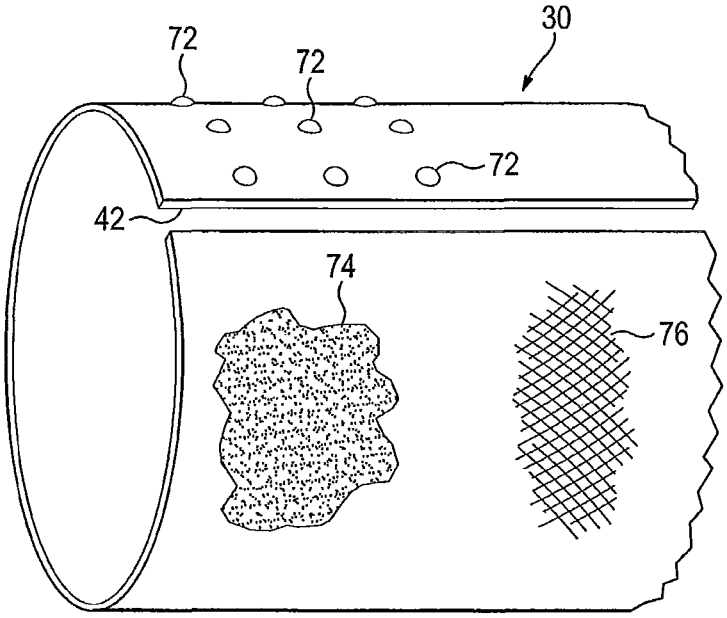
FIG. 6 is a perspective view of a portion of a core member that is a variation from the core member shown in FIG. 2.

As may be seen in FIG. 6, in one version the core 30 may have small studs or protrusions 72 located randomly or in a pattern on the exterior surface of the core 30, to aid in gripping against the interior surface 62 of the outer cover 32. Alternatively, the exterior surface of the core 30 may have an "orange peel" texture or configuration capable of engaging an inner surface of the outer cover 32, for aiding in gripping the interior surface 62 of the outer cover 32, and thereby preventing the outer cover 32 from slipping relative to the core 30, as shown at 74 in FIG. 6. As a further alternative, as shown at 76 in FIG. 6, the exterior surface of the core 30 may be scuffed or abraded to leave a roughened surface to grip the interior surface 62 of the outer cover 32, thereby preventing the outer cover 32 from slipping relative to the core 30.

Figure 7:
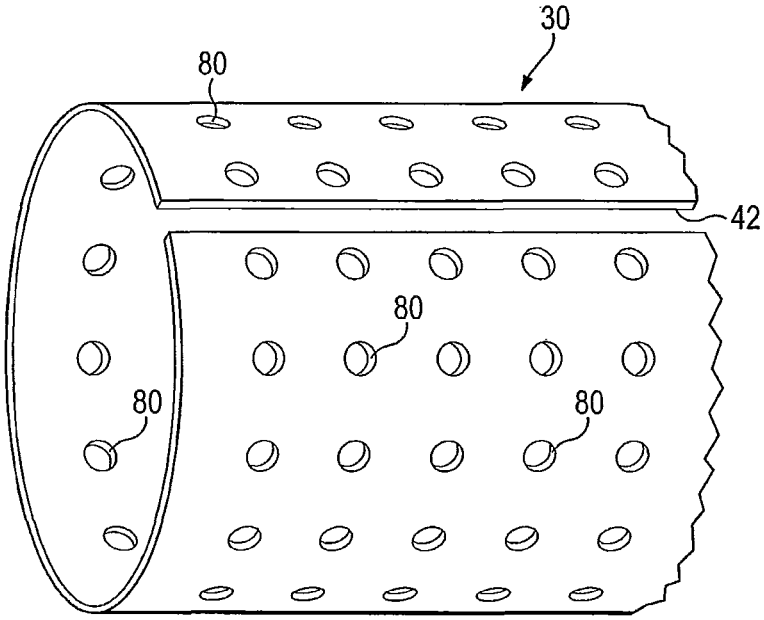
FIG. 7 is a perspective view of a portion of a core member of a paint roller sleeve assembly that is an embodiment of another aspect of the paint roller assembly disclosed herein.

It is known for paint rollers to be specially equipped to deliver a quantity of paint through the handle assembly 12 to the interior of a paint roller sleeve specially manufactured to include perforations in the cardboard or plastic core, to deliver paint from the interior of the special sleeve and thus obviate having to dip the roller periodically when painting. As shown in FIG. 7, therefore, the core 30 may include perforations 80 at fairly regular spacing and in patterns about the surfaces of the core 32 to permit the sleeve assembly 14 to be used on such a specially equipped handle assembly.

The outer cover 32 may be manufactured in at least two different manners. As discussed briefly above, a long strip of the inner, secondary backing material 60 can be wrapped into a tubular form on a suitable mandrel as a spiral, i.e., helical, wrap using known techniques for manufacture of conventional paint roller covers. The desired primary or outer backing layer 58 carrying the required pile layer 56 is then glued to the inner, secondary backing layer 60 in an offset location, similarly applying a long strip in a helical winding.

Alternatively, the outer cover 32 may be manufactured from sheet goods, with the secondary backing layer 60 applied to the primary backing layer 58 carrying the pile, using a gluing station to apply an adhesive in conventional ways such as a glue wheel or a spray applicator. Thereafter the combined layers may be moved through a joining and cutting station to compress the two backing layers together and cut the materials to a length corresponding to the circumference of the outer cover 32, so that when it is assembled its interior diameter will be slightly smaller than the outer diameter of the core 30, as described above. Sheets of the inner, secondary backing layer 60 material and primary backing material 58 and the associated pile 56 are combined in an offset pattern to keep the seams of the two products separate from each other. The glued combined layers may be moved onto an assembly rod or mandrel by a series of wheels that form the material into the required tubular shape and adhere the seams, compressing them for a secure bond.

Thereafter the assembly rod is rotated at a high rate to centrifugally "fluff" the fibers of the pile layer 56 while the pile is trimmed to the desired depth and the excess materials are removed to leave the outer cover 32 clean. Thereafter V notches are cut into the long tubes to establish the length of each separate outer cover 32 being manufactured, and finally the outer covers 32 are separated by cutting through the layers 58 and 60 of backing materials at the center of each V notch. The independent individual outer covers are then removed from the assembly rods and vacuumed clean for packaging.

Each outer cover 32 can be mounted on an associated core 30 when it is squeezed by hand to the extent possible as limited by the slit width 44. Once the outer cover 32 is in place surrounding the core 30, with the ends of the core 30 aligned with the ends of the outer cover 32, the grip on the core 30 can be released, allowing the core 30 to expand within the confines of the outer cover 32. The elastic force of the core 30 attempting to expand the holds the cover 32 securely in place on its core 30 to complete the sleeve assembly 14.

Placement of the sleeve assembly 14 onto the sleeve support 20 tends to expand the core 30 even more, as the rods 24 of a typical sleeve support 20 press outwardly against the interior of the core 30.

After the paint roller 10 has been used, the sleeve assembly 14 can be slid off the sleeve support portion 20 of the handle assembly 12, and by then manually squeezing the sleeve assembly 14, the core 30 can be compressed to release the outer cover 32 so that it can be removed from the core 30. With the outer cover 32 removed, the core 30 can easily be washed clean, and the outer cover 32 can also be washed clean, by spraying water or other paint solvent from within the outer cover 32 to remove paint from the fabric of the inner backing layer 60 and outer backing layer 58, as well as from the pile 56. The entire outer cover 32 can be squeezed while it is being rinsed and can also be squeezed to remove water from it after it has been rinsed clean. The ability to move water through the backing layers 58 and 60 as well as the nap or pile 56 reduces the amount of water necessary to clean the roller properly, potentially saving millions of gallons of water. The ease of cleaning the components of the sleeve assembly 14 described above makes it practical and economical to use the same outer cover 32 many times, in contrast to throwing an entire conventional roller sleeve away after a single day's use.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A paint roller sleeve assembly, comprising:

a. a rigid hollow cylindrical core in the form of a resiliently compressible tube having a length and a thin cylindrical tube wall, the tube wall defining a continuous slit extending longitudinally over all of said length, and the tube being free from any structures protruding inwardly from the tube wall and the cylindrical core thus being configured to fit around and be supported by a sleeve support portion of a paint roller handle assembly;

b. a flexible tubular outer cover on surrounding the cylindrical core and kept tight thereon by elastic expansive force exerted outwardly by the cylindrical core, the outer cover having a paint-carrying pile layer and a backing layer; and c. wherein the cylindrical core is sufficiently elastic to be resiliently and temporarily reduced in diameter by a great enough distance to relax outward pressure of the cylindrical core against an interior of the outer cover and thus to enable the outer cover to be slid longitudinally along and removed from the core and similarly to be replaced onto the core without damage to the flexible tubular outer cover.

2. The sleeve assembly of claim 1 wherein the slit has a slit width that is great enough that the core can be compressed radially far enough so that the outer cover can freely slide longitudinally along the core during removal from or replacement onto the core.

3. The roller sleeve assembly of claim 1 wherein the backing layer of the outer cover is of a porous, dimensionally stable textile fabric that is pervious to liquids.

4. The roller sleeve assembly of claim 1 wherein the outer cover includes an inner, secondary, backing, layer of a dimensionally stable sheet material.

5. The roller sleeve assembly of claim 4 wherein the inner backing layer is perforated.

6. The roller sleeve assembly of claim 4 wherein said inner backing layer is of a sheet material including an inner surface having a rubbery, non-slip texture.

7. The roller sleeve assembly of claim 1 wherein said core has a slip-resistant rough outer surface capable of engaging an inner surface of the outer cover, thereby preventing the outer cover from slipping relative to the core.

8. The roller sleeve assembly of claim 7 wherein the cylindrical core is tubular and is perforated with a plurality of holes distributed over the core and thereby providing a path to permit paint to be delivered to the outer cover from within the core.

9. The roller sleeve assembly of claim 1 wherein said core has a slip-resistant outer surface and includes a plurality of protrusions distributed about an outer surface of the core.

10. The roller sleeve assembly of claim 1 wherein said core has an exterior surface including a slip-resistant orange peel configuration capable of engaging an inner surface of the outer cover and thereby preventing the outer cover from slipping relative to the core.

11. A method of washing a paint roller sleeve assembly, comprising:

(a) providing:

(i) a rigid hollow cylindrical core in the form of a tube of an elastic material having a length and a tube wall, the tube wall defining a continuous slit extending longitudinally over all of said length, and the tube being free from any structures protruding inwardly from the tube wall and the cylindrical core thus being configured to fit on around and be supported by a sleeve support portion of a paint roller handle assembly; and (ii) a flexible tubular outer cover surrounding the cylindrical core and kept tight thereon by elastic expansive force exerted outwardly by the cylindrical core, the outer cover having a paint-carrying pile layer and a backing layer of flexible fabric; and (iii) wherein the hollow cylindrical core is sufficiently elastic to be resiliently and temporarily reduced in diameter by a great enough distance to relax outward pressure of the cylindrical core against an interior of the outer cover and thus to enable the outer cover to be slid longitudinally along and removed from the core and similarly to be replaced onto the core without damage to the flexible tubular outer cover; and (b) compressing the hollow cylindrical core within the surrounding tubular outer cover sufficiently to loosen the tubular outer cover, (c) sliding the tubular outer cover along the hollow cylindrical core and thereby removing the tubular outer cover from the hollow cylindrical core;

d) washing the hollow cylindrical core and the tubular outer cover separately; and (e) replacing the tubular outer cover onto the hollow cylindrical core.

* * * * *